US007232634B2

(12) United States Patent
Tong et al.

(10) Patent No.: US 7,232,634 B2
(45) Date of Patent: Jun. 19, 2007

(54) IMAGING MEMBER

(75) Inventors: Yuhua Tong, Webster, NY (US); Timothy J. Fuller, Pittsford, NY (US); Sean X. Pan, Webster, NY (US); John F. Yanus, Webster, NY (US); Alexander N. Klymachyov, Webster, NY (US); Min-Hong Fu, Webster, NY (US); Dennis J. Prosser, Walworth, NY (US); Susan M. VanDusen, Williamson, NY (US)

(73) Assignee: Xerox Corporation, Stamford, CT (US)

( * ) Notice: Subject to any disclaimer, the term of this patent is extended or adjusted under 35 U.S.C. 154(b) by 293 days.

(21) Appl. No.: 10/954,378

(22) Filed: Sep. 30, 2004

(65) Prior Publication Data

US 2006/0068309 A1 Mar. 30, 2006

(51) Int. Cl.
*G03G 5/06* (2006.01)

(52) U.S. Cl. ..... 430/74; 430/58.65; 430/58.8

(58) Field of Classification Search ..... 430/58.65, 430/58.8, 58.75, 74
See application file for complete search history.

(56) References Cited

U.S. PATENT DOCUMENTS 3,121,006 A 2/1964 Middleton et al.
4,025,341 A 5/1977 Rule
4,233,384 A 11/1980 Turner et al.
4,265,990 A 5/1981 Stolka et al.
4,286,033 A 8/1981 Neyhart et al.
4,291,110 A 9/1981 Lee
4,299,897 A 11/1981 Stolka et al.
4,306,008 A 12/1981 Pai et al.
4,338,387 A 7/1982 Hewitt
4,346,158 A 8/1982 Pai et al.
4,439,507 A 3/1984 Pan et al.
4,654,284 A 3/1987 Yu et al.
4,806,443 A 2/1989 Yanus et al.
4,988,597 A 1/1991 Spiewak et al.
5,244,762 A 9/1993 Spiewak et al.
5,613,173 A 3/1997 Kunzmann et al.
6,099,996 A * 8/2000 Yanus et al. ..... 430/58.8
6,361,913 B1 * 3/2002 Pai et al. ..... 430/58.3
6,677,090 B1 * 1/2004 Tong et al. ..... 430/58.75

* cited by examiner

*Primary Examiner*—John L Goodrow
(74) *Attorney, Agent, or Firm*—Eugene O. Palazzo; Fay Sharpe LLP

(57) ABSTRACT

A charge transport layer for an imaging member comprising a charge transport material with a nitrogen molecular defense system not exhibiting early onset of charge transport layer fatigue cracking. The nitrogen molecular defense system includes attaching bulky organic groups to charge transport materials. The bulky groups aid in preventing recrystallization of the charge transport molecule and shield the nitrogen from molecular attack, such as by oxidation. The charge transport layer exhibits excellent wear resistance, excellent electrical performance, and outstanding print quality.

10 Claims, 2 Drawing Sheets

IMAGING MEMBER

BACKGROUND

This disclosure relates in general to electrostatography and, more specifically, to an electrostatographic imaging member having a charge transport layer comprising a stereo-hindered charge transport material containing bulky organic groups, and a method for protecting the nitrogen atoms of charge transport materials and, thus, the charge transport layer from chemical damage.

In the art of electrophotography, an electrophotographic plate comprising a photoconductive insulating layer on a conductive layer is imaged by first uniformly electrostatically charging the surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles, for example from a developer composition, on the surface of the photoconductive insulating layer. The resulting visible toner image can be transferred to a suitable receiving member such as paper.

Electrophotographic imaging members are usually multilayered photoreceptors that comprise a substrate support, an electrically conductive layer, an optional charge blocking layer, an optional adhesive layer, a charge generating layer, a charge transport layer, and an optional protective or overcoating layer(s). The imaging members can take several forms, including flexible belts, rigid drums, etc. For many multilayered flexible photoreceptor belts, an anti-curl layer is usually employed on the backside of the substrate support, opposite to the side carrying the electrically active layers, to achieve the desired photoreceptor flatness.

Various combinations of materials for charge generating layers and charge transport layers have been investigated. U.S. Pat. No. 4,265,990 discloses a layered photoreceptor having a separate charge generating (photogenerating) layer (CGL) and charge transport layer (CTL). The charge generating layer is capable of photogenerating holes and injecting the photogenerated holes into the charge transport layer. The photogenerating layer utilized in multilayered photoreceptors includes, for example, inorganic photoconductive particles or organic photoconductive particles dispersed in a film forming polymeric binder. Inorganic or organic photoconductive materials may be formed as a continuous, homogeneous photogenerating layer. The disclosure of U.S. Pat. No. 4,265,990 is incorporated herein by reference.

Examples of photosensitive members having at least two electrically operative layers including a charge generating layer and diamine containing transport layer are disclosed in U.S. Pat. Nos. 4,265,990, 4,233,384, 4,306,008, 4,299,897 and 4,439,507. The disclosures of these patents are incorporated herein in their entirety. Charge transport layers are known to be comprised of any of several different types of charge transport material dispersed in a polymer binder.

U.S. Pat. No. 4,806,443 describes a charge transport layer including a polyether carbonate (PEC) obtained from the condensation of N,N'-diphenyl N'-bis(3-hydroxyphenyl)-[1,1'-biphenyl]-4,4'-diamine and diethylene glycol bischloroformate. U.S. Pat. No. 4,025,341 similarly describes that a photoreceptor includes a charge transport layer including any suitable hole transporting material such as poly(oxycarbonyloxy-2-methyl-1,4-phenylenecyclohexylidene-3-methyl-1,4-phenylene.

In multilayer photoreceptor devices, one property, for example, is the charge carrier mobility in the transport layer. Charge carrier mobility determines the velocities at which the photo-injected carriers transit the transport layer. For greater charge carrier mobility capabilities, for example, it may be necessary to increase the concentration of the active molecule transport compounds dissolved or molecularly dispersed in the binder. Phase separation or crystallization sets an upper limit to the concentration of the transport molecules that can be dispersed in a binder.

In conventional layered organic photoreceptor devices, the charge transport layer (CTL) generally includes an activating compound dispersed in electrically inactive polymeric materials, thereby making the polymeric materials electrically active. Generally, the charge transport layer includes charge transport small molecules (CTM) and polymer binders. Typical inactive resin binders include polycarbonate resin, polyether carbonate, polyester, polyarylate, polyether, polysulphone, and the like. The charge transport molecules typically include aromatic amine compounds such as N N', diphenyl-N,N'-di(m-tolyl)-p-benzidine [TPD].

The charge transport layer, however, is a thin coating layer of usually less than 40 microns. Because the charge transport layer is thin and there are no special chemical interactions between the charge transport molecules and the polymeric binders, the charge transport layer generally exists in a meta-stable state. Consequently, these kinds of charge transport molecules are susceptible to crystallization, which causes physical damage to the charge transport layer such as phase deformation, and low wear resistance.

Further, the small charge transport molecules, and particularly the nitrogen atoms of the charge transport molecules, may be easily oxidized by ozone, nitric oxide and other oxidative materials generated under normal operational conditions. In this regard, the nitrogen atom, connected with conjugated molecular structures like double bonds and/or benzene rings, is the core for charge transport materials. Consequently, the protection of nitrogen from chemical change is very important for organic photoreceptor devices.

These problems may be overcome in some degree by the use of a second transport layer having a higher concentration of donor or acceptor molecules, the use of a single layer with a concentration gradient, or the incorporation of antioxidant materials into the transport layer. The electrical properties of devices employing such methods, however, are often significantly compromised.

What is still desired is an improved material for a charge transport layer of an imaging member that exhibits excellent performance properties and has the further advantages of not being susceptible to crystallization, oxidation or chemical attack/damage when present in the charge transport layer.

These and other non-limiting aspects and/or objects of the development are more particularly disclosed below.

BRIEF DESCRIPTION OF THE DRAWINGS

The following is a brief description of the drawings which are presented for the purposes of illustrating the disclosure set forth herein and not for the purposes of limiting the same.

BRIEF DESCRIPTION

Figure 1:
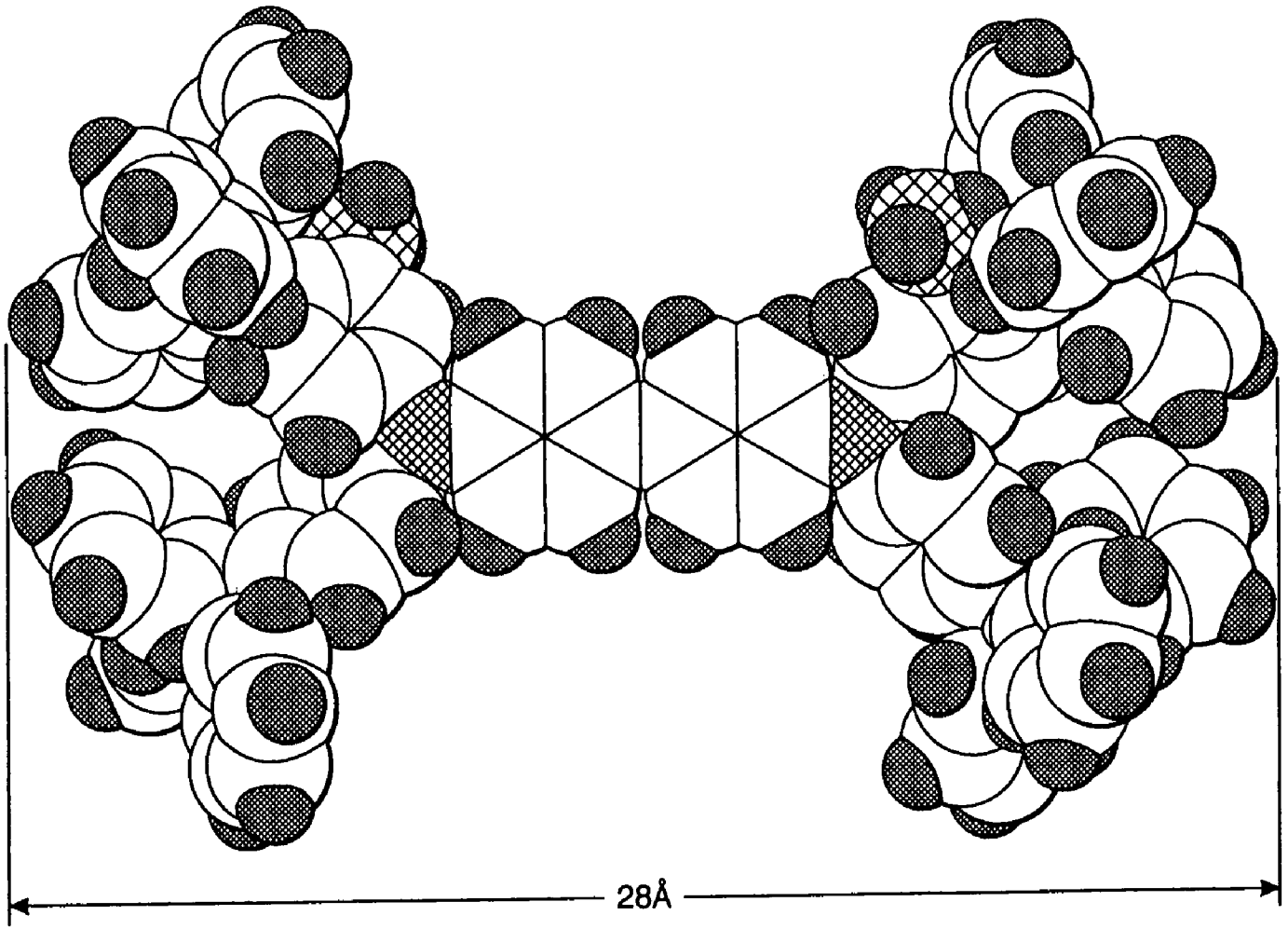
FIG. 1 is a model drawing illustrating the molecular structure of stereo-hindered TPD of Formula C.

In one aspect, the present disclosure is directed to the design and synthesis of a new class of charge transport molecules and the charge transport layers, imaging members and photoreceptors produced using the same. The charge transport molecules are stereo-hindered charge transport molecules. The stereo-hindrance stabilizes and protects the radical cation, nitrogen, etc., of the charge transport molecule resulting in a charge transport layer having improved properties.

In accordance with another aspect of the disclosure, an imaging member is provided comprising a charge transport layer, wherein the charge transport layer comprises a stereo-hindered charge transport molecule and a polymer binder. The charge transport layer exhibits improved resistance to nitrogen oxidation recrystallization, etc.

The stereo-hindered charge transport molecule may be an amine compound such as an aromatic amine compound having the Formula A:

Formula A

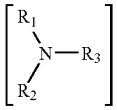

wherein $R_1$ and $R_2$ are an aromatic group selected from the group consisting of substituted or unsubstituted phenyl, naphthyl, polyphenyl and combinations thereof, $R_3$ is selected from the group consisting of substituted or unsubstituted aryl, alkyl having from 1 to 18 carbon atoms and cycloaliphatic compounds having from 3 to 18 carbon atoms, and at least one of $R_1$ and $R_2$ have a bulky organic compound attached thereto. For example, the bulky organic compound may be triphenylmethyl. The resulting imaging members exhibit improved properties such as resistance to claimed attacks, resistance to crystallization, etc.

In another aspect of the disclosure, an imaging member is provided comprising a supporting substrate, a charge generating layer, and a charge transport layer. The charge transport layer comprises a charge transport molecule represented by the formula:

Formula B

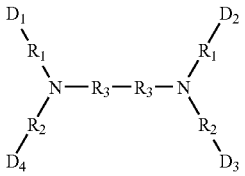

wherein $R_1$ and $R_2$ are independently selected from the group consisting of alkyl with from 1 to 12 carbon atoms, an alkyl with from 1 to 12 carbon atoms substituted by aryl groups, substituted or unsubstituted phenyl, substituted or unsubstituted naphthyl, substituted or unsubstituted ethyl, and substituted or unsubstituted poly phenyl. $R_3$ is selected from the group consisting of substituted or unsubstituted aryl, alkyl having from 1 to 18 carbon atoms, and cycloaliphatic compounds having from 3 to 18 carbon atoms. $D_1$, $D_2$, $D_3$, and $D_4$ are tertiary alkyl having bulky moieties attached thereto. For example, $D_1$, $D_2$, $D_3$, and $D_4$ may be triphenylmethyl groups, and $R_1$ and $R_2$ are independently selected from the group consisting of substituted or unsubstituted phenyl.

In a further aspect of the disclosure, a charge transport layer composition for a photo-imaging member is produced. The charge transport layer composition comprises a nitrogen molecular defense system, the nitrogen molecular defense system comprises a stereo-hindered charge transport molecule. For example, the stereo-hindered charge transport molecule may be a stereo-hindered amine compound, such as a stereo-hindered aromatic amine compound of the formula:

Formula A

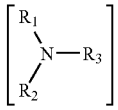

and $R_1$ and $R_2$ have bulky organic compounds attached thereto. The bulky organic compound may be triphenylmethyl, including tert-butyl and the substituted derivatives, tri(methylphenyl)methyl, tri(ethylphenyl)methyl, tri(tert-butylphenyl)methyl. The bulky group(s) inhibits the charge transport molecules from recrystallizing in the charge transport layer, resulting in a more stable layer.

DETAILED DESCRIPTION

Disclosed herein is an imaging member comprising a charge transport layer, wherein the charge transport layer comprises a stereo-hindered charge transport molecule in a polymeric binder. Further disclosed herein is a charge transport layer composition for a photoimaging member. The charge transport layer composition comprises a nitrogen molecular defense system.

Additionally disclosed is a stereo-hindered charge transport molecule having bulky organic group(s) attached thereto that does not exhibit early onset of charge transport layer fatigue cracking. By the use of the disclosed stereo-hindered materials in the charge transport layer, a charge transport layer of an imaging member is achieved that has excellent hole transporting performance, less crystallization, reduced susceptibility to oxidation and better wear resistance. The charge transport layer is also able to be coated onto the imaging member structure using known conventional methods.

The charge transport layer of a photoreceptor must be capable of supporting the injection of photo-generated holes and electrons from a charge generating layer and allowing the transport of these holes or electrons through the organic layer to selectively discharge the surface charge. If some of the charges are trapped inside the transport layer, the surface charges will not completely discharge and the toner image will not be fully developed on the surface of the photoreceptor. An active charge transport layer thus generally comprises an activating compound useful as an additive dispersed in electrically inactive polymeric materials making these materials electrically active. These compounds, referred to as charge transport molecules (CTMs), may be added to polymeric materials, which are incapable of supporting the injection of photogenerated holes from the generation material and incapable of allowing the transport of these holes there through. This will convert the electrically inactive polymeric material to a material capable of supporting the injection of photogenerated holes from the generation material and capable of allowing the transport of these holes through the active layer in order to discharge the surface charge on the active layer.

An example transport layer that may be employed in multilayered photoconductors of this disclosure comprises from about 10 percent to about 90 percent by weight, including from about 25 percent to about 75 percent by weight, of at least one charge transporting aromatic amine compound, and about 10 percent to about 90 percent by weight, including from about 75 percent to about 25 percent by weight, of a polymeric film forming resin in which the aromatic amine is soluble.

The charge transport layer forming mixture preferably comprises an aromatic amine compound of one or more compounds having the general formula:

Formula A

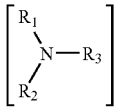

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having 1 to about 18 carbon atoms and cycloaliphatic compounds having from about 3 to about 18 carbon atoms. The substituents should preferably be free from electron withdrawing groups such as $NO_2$ groups, CN groups, and the like.

Charge transport molecules of the present disclosure further include a bulky organic group attached to at least one of and preferably both R1 and R2. The bulky organic group sterically hinder the charge transport molecule and help protect the amine nitrogen from chemical attach such as oxidation.

For example, in embodiments, a charge transport molecule comprises a stereo-hindered charge transporting aromatic amine represented by:

Formula B

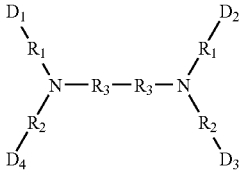

wherein $R_1$ and $R_2$ are independently selected from substituted or unsubstituted phenyl, naphthyl, and polyphenyl, $R_3$ is selected from the group consisting of substituted or unsubstituted aryl groups, alkyl groups having 1 to 18 carbon atoms, and cycloaliphatic compounds having 3 to 18 carbon atoms, and $D_1$, $D_2$, $D_3$ and $D_4$ are bulky organic molecules.

Suitable charge transporting aromatic amines represented by the above formula, which may be modified with bulky organic moieties include N,N,'-bis(alkyl phenyl)-[1,1'-biphenyl]-4,4'diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3-methylphenyl)-(1,1'-biphenyl)-4,4'-diamine, N,N'-diphenyl-N,N'-bis(3-hydroxphenyl)-1,1'-biphenyl)-4,4'-diamine, tri(methylphenyl)amine, N,N-bis(3,4-dimethylphenyl)-1-aminobiphenyl, and the like. Any bulky organic molecule that is capable of sterically hindering the charge transporting aromatic amine and/or shield the nitrogen atoms may be used as the D components. Further $D_1$, $D_2$, $D_3$ and $D_4$ may either be the same bulky organic compound or independently different compounds. Suitable bulky organic compounds include tertiary methyls such as triphenyl methyl. Other examples include tert-butyl and the substituted derivatives, tri(methylphenyl)methyl, tri(ethylphenyl)methyl, tri(tert-butylphenyl)methyl.

In embodiments, the charge transporting aromatic amine portion of the stereo-hindered charge transport molecules, which is represented by Formula B, may also be represented by:

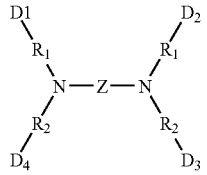

wherein Z may be selected from the group consisting of:

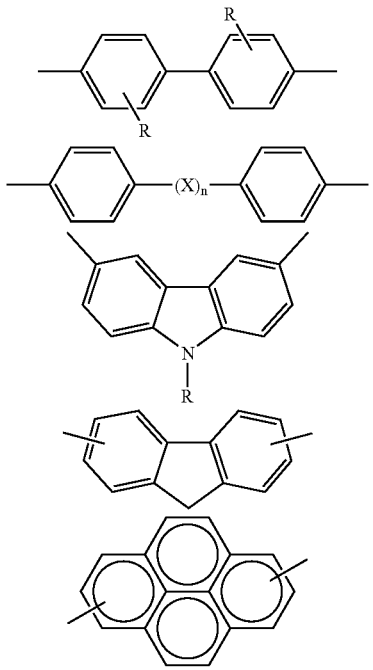

wherein the R of the Z group is selected from the group consisting of —$CH_3$, —$C_2H_5$, —$C_3H_7$, and —$C_4H_9$, X is selected from the group consisting of —$CH_2$—, —$C(CH_3)_2$—, —O—, —S—, and n is 0 or 1.

Any arylamine compound suitable as a charge transport material may be used in the present disclosure, and is not limited to those amines specifically described herein. One or more bulky side groups are attached to such amines in a position relative to the amine nitrogen to either sterically hinder the charge transport material and/or shield in nitrogen from molecular attack, e.g., oxidation.

A suitable stereo-hindered charge transporting material includes N,N'-diphenyl-N,N'-bis(alkyl phenyl)-1,1'-biphenyl-4,4'-diamine modified with triphenyl methyl substituents. Such a suitable compound is N,N'-di-4-(triphenylmethyl)phenyl-N,N'-di-(3-methyl-4-(triphenylmethyl)) phenyl-1,1'biphenyl-4,4'-diamine, which is represented by:

Formula C

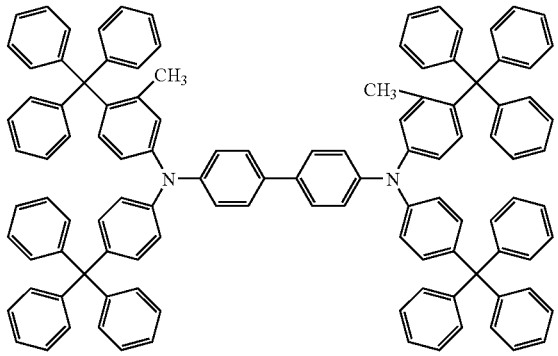

This is a relatively large molecule, i.e., about 28 Å. See FIG. 1. Additionally, the nitrogen atoms are shielded by the bulky groups, such as the triphenylmethyl groups, at both ends. The bulky groups prevent the charge transport molecule from recrystallizing in the charge transport layer, resulting in a more stable layer. Additionally, the stereo-hindrance stabilizes/protects the radical cation of the charge transport molecule resulting in an improved charge transport layer.

For example, in embodiments the charge transport layer comprises from about 10 percent to about 90 percent by weight of at least one charge transport material disclosed herein and about 90 percent to about 10 percent by weight of a polymer binder. The dried charge transport layer can contain from about 30 percent and about 70 percent by weight of a charge transport molecule based on the total weight of the dried charge transport layer.

The charge transport layer material may also include additional additives. Such as, for example, antioxidants, leveling agents, surfactants, wear resistant additives such as polytetrafluoroethylene (PTFE) particles, light shock resisting or reducing agents, and the like.

A solvent system can be included as a further component of the charge transport layer material. The stereo-hindered charge transport molecules of the present disclosure exhibit very good solubility in methylene chloride, toluene, and tetrahydrofuran. These are the most common solvents used in the coating of the charge transport layer. The solvents render the coating suitable for application via e.g., dip coating. However, methylene chloride has environmental concerns that usually require this solvent to have special handling and results in the need for more expensive coating and clean-up procedures. Currently, however, binder resins can be dissolved in a solvent system that is more environmentally friendly than methylene chloride, thereby enabling the charge transport layer to be formed less expensively than with some conventional polycarbonate binder resins. In embodiments a solvent system for use with the charge transport layer material of the present disclosure comprises tetrahydrofuran, toluene, and the like.

Additionally, the stereo-hindered charge transporting aromatic amines of the disclosure are miscible with polymer binder materials, and in particular with polycarbonate, which is the most widely used polymer binder. Any suitable inactive resin binder may be employed in the photoreceptors of this development. Typical inactive resin binders include polycarbonate resin, polyether carbonate, polyester, polyarylate, polyacrylate, polyether, polysulfone, and the like. Weight average molecular weights can vary from about 20,000 to about 150,000. Thus, the stereo-hindered charge transport molecules and binder form a uniformly transparent film. Further, because of the giant molecular structure, the stereo-hindered charge transporting aromatic amines do not easily crystallize in the polymer binder.

The stereo-hindered charge transporting aromatic amines are generally prepared by the addition reaction of an aromatic amine (that is suitable as a CTM) with a bulky organic compound. For example, N,N'-di(triphenylmethyl phenyl)-N,N'-bis(alkyl(triphenylmethyl phenyl))-1,1'-biphenyl-4,4'-diamine is prepared by the addition reaction of TPD and triphenylmethylchloride with the proper catalysts.

The stereo-hindered charge transporting molecules disclosed herein provide a nitrogen-molecular defense system. While not being bound to any particular theory, it is believed that the highly stereo-hindered charge transport molecules serve to shield the nitrogen atoms on the base CTM structure from chemical attacks. For example, in the highly stereo-hindered charge transport molecule N,N'-di(triphenylmethyl phenyl)-N,N'-bis(alkyl(triphenylmethyl phenyl))-1,1'-biphenyl-4,4'diamine, it is believed that the crowding of benzene rings around the nitrogen serve as the shield thereby protecting the nitrogen molecules from chemical attacks.

Any suitable multilayer photoreceptor may be employed in the imaging member of this disclosure utilizing a charge transport layer having the above described composition and characteristics. The charge generating layer and charge transport layer as well as the other layers may be applied in any suitable order to produce either positive or negative charging photoreceptors. For example, the charge generating layer may be applied prior to the charge transport layer, as illustrated in U.S. Pat. No. 4,265,990, or the charge transport layer may be applied prior to the charge generating layer, as illustrated in U.S. Pat. No. 4,346,158, the entire disclosures of these patents being incorporated herein by reference. In embodiments, however, the charge transport layer is employed upon a charge generating layer, and the charge transport layer may optionally be overcoated with an overcoat and/or protective layer.

A photoreceptor of this disclosure employing the charge transport layer may comprise a substrate, a hole blocking layer, an optional adhesive layer, a charge generating layer, the charge transport layer, and one or more optional overcoat and/or protective layer(s).

The photoreceptor substrate may be opaque or substantially transparent, and may comprise any suitable organic or inorganic material having the requisite mechanical properties The substrate can be formulated entirely of an electrically conductive material, or it can be an insulating material including inorganic or organic polymeric materials, such as MYLAR® a commercially available polymer, MYLAR® coated titanium, a layer of an organic or inorganic material having a semiconductive surface layer, such as indium tin oxide, aluminum, titanium, and the like, or exclusively be made up of a conductive material such as aluminum, chromium, nickel, brass, and the like. The substrate may be flexible, seamless or rigid and may have a number of many different configurations, such as, for example, a plate, a drum, a scroll, an endless flexible belt, and the like. In one embodiment, the substrate is in the form of a seamless flexible belt. The back of the substrate, particularly when the substrate is a flexible organic polymeric material, may optionally be coated with a conventional anticurl layer having an electrically conductive surface. The thickness of the substrate layer depends on numerous factors, including mechanical performance and economic considerations. The thickness of this layer may range from about 65 micrometers to about 3,000 micrometers, and in embodiments from about 75 micrometers to about 1,000 micrometers for optimum flexibility and minimum induced surface bending stress when cycled around small diameter rollers, for example, 19 millimeter diameter rollers. The surface of the substrate layer is in embodiments cleaned prior to coating to promote greater adhesion of the deposited coating composition. Cleaning may be effected by, for example, exposing the surface of the substrate layer to plasma discharge, ion bombardment, and the like methods. Similarly, the substrate can be either rigid or flexible. In embodiments, the thickness of this layer is from about 3 millimeters to about 10 millimeters. For flexible belt imaging members, for example, substrate thicknesses are from about 65 to about 150 microns, and in embodiments from about 75 to about 100 microns for optimum flexibility and minimum stretch when cycled around small diameter rollers of, for example, 19 millimeter diameter. The entire substrate can comprise the same material as that in the electrically conductive surface or the electrically conductive surface can be merely a coating on the substrate. Any suitable electrically conductive material can be employed. Typical electrically conductive materials include copper, brass, nickel, zinc, chromium, stainless steel, conductive plastics and rubbers, aluminum, semitransparent aluminum, steel, cadmium, silver, gold, zirconium, niobium, tantalum, vanadium, hafnium, titanium, nickel, chromium, tungsten, molybdenum, paper rendered conductive by the inclusion of a suitable material therein or through conditioning in a humid atmosphere to ensure the presence of sufficient water content to render the material conductive, indium, tin, metal oxides, including tin oxide and indium tin oxide, and the like.

The conductive layer of the substrate can vary in thickness over substantially wide ranges depending on the desired use of the electrophotoconductive member. Generally, the conductive layer ranges in thickness from about 50 Angstroms to many centimeters, although the thickness can be outside of this range. When a flexible electrophotographic imaging member is desired, the thickness of the conductive layer typically is from about 20 Angstroms to about 750 Angstroms, and in embodiments from about 100 to about 200 Angstroms for an optimum combination of electrical conductivity, flexibility, and light transmission. A hole blocking layer may then optionally be applied to the substrate. Generally, electron blocking layers for positively charged photoreceptors allow the photogenerated holes in the charge generating layer at the surface of the photoreceptor to migrate toward the charge (hole) transport layer below and reach the bottom conductive layer during the electrophotographic imaging processes. Thus, an electron blocking layer is normally not expected to block holes in positively charged photoreceptors such as photoreceptors coated with a charge generating layer over a charge (hole) transport layer. For negatively charged photoreceptors, any suitable hole blocking layer capable of forming an electronic barrier to holes between the adjacent photoconductive layer and the underlying zirconium or titanium layer may be utilized. A hole blocking layer may comprise any suitable material. The charge blocking layer may include polymers such as polyvinylbutyral, epoxy resins, polyesters, polysiloxanes, polyamides, polyurethanes, and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearyl titanate, isopropyl tri(N-ethylamino-ethylamino)titanate, isopropyl trianthranil titanate, isopropyl tri(N,N-dimethyl-ethylamino)titanate, titanium-4-amino benzene sulfonate oxyacetate, titanium 4-aminobenzoate isostearate oxyacetate, [H2N(CH2)4]CH3Si(OCH3)2, gamma-aminobutyl) methyl diethoxysilane, and [H2N (CH2)3]CH3Si(OCH3)2, (gamma-aminopropyl)-methyl diethoxysilane, as disclosed in U.S. Pat. Nos. 4,338,387, 4,286,033 and 4,291,110. Other suitable charge blocking layer polymer compositions are also described in U.S. Pat. No. 5,244,762. These include vinyl hydroxyl ester and vinyl hydroxy amide polymers wherein the hydroxyl groups have been partially modified to benzoate and acetate esters that modified polymers are then blended with other unmodified vinyl hydroxy ester and amide unmodified polymers. An example of such a blend is a 30 mole percent benzoate ester of poly (2-hydroxyethyl methacrylate) blended with the parent polymer poly (2-hydroxyethyl methacrylate). Still other suitable charge blocking layer polymer compositions are described in U.S. Pat. No. 4,988,597. These include polymers containing an alkyl acrylamidoglycolate alkyl ether repeat unit. An example of such an alkyl acrylamidoglycolate alkyl ether containing polymer is the copolymer poly(methyl acrylamidoglycolate methyl ether-co-2-hydroxyethyl methacrylate). The disclosures of the U.S. Patents are incorporated herein by reference in their entirety.

The blocking layer is continuous and may have a thickness of less than about 10 micrometers because greater thicknesses may lead to undesirably high residual voltage. In embodiments, a blocking layer of from about 0.005 micrometers to about 1.5 micrometers facilitates charge neutralization after the exposure step and optimum electrical performance is achieved. The blocking layer may be applied by any suitable conventional technique such as spraying, dip coating, draw bar coating, gravure coating, silk screening, air knife coating, reverse roll coating, vacuum deposition, chemical treatment, and the like. For convenience in obtaining thin layers, the blocking layer is, in embodiments, applied in the form of a dilute solution, with the solvent being removed after deposition of the coating by conventional techniques such as by vacuum, heating, and the like. Generally, a weight ratio of blocking layer material and solvent of between about 0.05:100 to about 5:100 is satisfactory for spray coating.

If desired an optional adhesive layer may be formed on the substrate. Any suitable solvent may be used to form an adhesive layer coating solution. Typical solvents include tetrahydrofuran, toluene, hexane, cyclohexane, cyclohexanone, methylene chloride, 1,1,2-trichloroethane, monochlorobenzene, and the like, and mixtures thereof. Any suitable technique may be utilized to apply the adhesive layer coating. Typical coating techniques include extrusion coating, gravure coating, spray coating, wire wound bar coating, and the like. The adhesive layer is applied directly to the charge blocking layer. Thus, the adhesive layer is in embodiments in direct contiguous contact with both the underlying charge blocking layer and the overlying charge generating layer to enhance adhesion bonding and to effect ground plane hole injection suppression. Drying of the deposited coating may be effected by any suitable conventional process such as oven drying, infrared radiation drying, air drying, and the like. The adhesive layer should be continuous. Satisfactory results are achieved when the adhesive layer has a thickness of from about 0.01 micrometers to about 2 micrometers after drying. In embodiments, the dried thickness is from about 0.03 micrometers to about 1 micrometer. At thicknesses of less than about 0.01 micrometers, the adhesion between the charge generating layer and the blocking layer is poor and delamination can occur when the photoreceptor belt is transported over small diameter supports such as rollers and curved skid plates. When the thickness of the adhesive layer is greater than about 2 micrometers, excessive residual charge buildup is observed during extended cycling. The components of the photogenerating layer comprise photogenerating particles for example, of Type V hydroxygallium phthalocyanine, x-polymorph metal free phthalocyanine, or chlorogallium phthalocyanine photogenerating pigments dispersed in a matrix comprising an arylamine hole transport molecules and certain selected electron transport molecules. Type V hydroxygallium phthalocyanine is well known and has X-ray powder diffraction (XRPD) peaks at, for example, Bragg angles (2 theta +/−0.2°) of 7.4, 9.8, 12.4, 16.2, 17.6, 18.4, 21.9, 23.9, 25.0, 28.1, with the highest peak at 7.4 degrees. The X-ray powder diffraction traces (XRPDs) were generated on a Philips X-Ray Powder Diffractometer Model 1710 using X-radiation of CuK-alpha wavelength (0.1542 nanometer). The Diffractometer was equipped with a graphite monochrometer and pulse-height discrimination system. Two-theta is the Bragg angle commonly referred to in x-ray crystallographic measurements. I (counts) represents the intensity of the diffraction as a function of Bragg angle as measured with a proportional counter. Type V hydroxygallium phthalocyanine may be prepared by hydrolyzing a gallium phthalocyanine precursor including dissolving the hydroxygallium phthalocyanine in a strong acid and then reprecipitating the resulting dissolved precursor in a basic aqueous media; removing any ionic species formed by washing with water; concentrating the resulting aqueous slurry comprising water and hydroxygallium phthalocyanine as a wet cake; removing water from the wet cake by drying; and subjecting the resulting dry pigment to mixing with a second solvent to form the Type V hydroxygallium phthalocyanine. These pigment particles in embodiments have an average particle size of less than about 5 micrometers.

The photogenerating layer containing photoconductive compositions and/or pigments and the resinous binder material generally ranges in thickness of from about 0.1 micrometers to about 5.0 micrometers, and in embodiments has a thickness of from about 0.3 micrometers to about 3 micrometers. Thicknesses outside of these ranges can be selected. The photogenerating layer thickness is generally related to binder content. Thus, for example, higher binder content compositions generally result in thicker layers for photogeneration.

Any suitable film forming binder may be utilized in the photoconductive insulating layer. Examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetyls, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinone)s, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers.

Specific electrically inactive binders include polycarbonate resins with a weight average molecular weight of from about 20,000 to about 100,000. In embodiments, a weight average molecular weight of from about 50,000 to about 100,000 is specifically selected. More specifically, excellent imaging results are achieved with poly(4,4'-diphenyl-1,1'-cyclohexane carbonate) polycarbonate; poly(4,4'-diphenyl-1,1'-cyclohexane carbonate) {PCZ-500 [Lupilon® 500—Mitsubishi Gas Chemical Corp with a weight average molecular weight of 51,000; or poly(4,4'-diphenyl-1,1'-cyclohexane carbonate) {PCZ-400 [Lupilon® 400—Mitsubishi Gas Chemical Corp], with a weight average molecular weight of 40,000}.

The thickness of the photogenerating binder layer may not be particularly critical. Layer thicknesses of from about 0.05 micrometers to about 100.0 micrometers may be satisfactory and in embodiments from about 0.05 micrometers to about 40.0 micrometers thick. The photogenerating binder layer containing photoconductive compositions and/or pigments, and the resinous binder material in embodiments, ranges in thickness of from about 0.1 micrometers to about 5.0 micrometers, and has an optimum thickness of from about 0.3 micrometers to about 3 micrometers for best light absorption and improved dark decay stability and mechanical properties.

When the photogenerating material is present in the binder material, the photogenerating composition or pigment may be present in the film forming polymer binder compositions in any suitable or desired amounts. For example, from about 10 percent by volume to about 60 percent by volume of the photogenerating pigment may be dispersed in from about 40 percent by volume to about 90 percent by volume of the film forming polymer binder composition, and in embodiments from about 20 percent by volume to about 30 percent by volume of the photogenerating pigment may be dispersed in about 70 percent by volume to about 80 percent by volume of the film forming polymer binder composition. Typically, the photoconductive material is present in the photogenerating layer in an amount of from about 5 to about 80 percent by weight, and in embodiments from about 25 to about 75 percent by weight, and the binder is present in an amount of from about 20 to about 95 percent by weight, and in embodiments from about 25 to about 75 percent by weight, although the relative amounts can be outside these ranges.

The photogenerating layer containing photoconductive compositions and the resinous binder material generally ranges in thickness from about 0.05 microns to about 10 microns or more, and in embodiments from about 0.1 microns to about 5 microns, and in more specific embodiments having a thickness of from about 0.3 microns to about 3 microns, although the thickness may be outside these ranges. The photogenerating layer thickness is related to the relative amounts of photogenerating compound and binder, with the photogenerating material often being present in amounts of from about 5 to about 100 percent by weight. Higher binder content compositions generally require thicker layers for photogeneration. Generally, it is desirable to provide this layer in a thickness sufficient to absorb about 90 percent or more of the incident radiation which is directed upon it in the imagewise or printing exposure step. The maximum thickness of this layer is dependent primarily upon factors such as mechanical considerations, the specific photogenerating compound selected, the thicknesses of the other layers, and whether a flexible photoconductive imaging member is desired. The photogenerating layer can be applied to underlying layers by any desired or suitable method. Any suitable technique may be utilized to mix and thereafter apply the photogenerating layer coating mixture. Typical application techniques include spraying, dip coating, roll coating, wire wound rod coating, and the like. Drying of the deposited coating may be effected by any suitable technique, such as oven drying, infrared radiation drying, air drying, and the like.

The charge transport layer comprises the stereo-hindered charge transport molecule set forth above. This molecule is capable of supporting the injection of photogenerated holes or electrons from the charge generating layer and allowing the transport of these holes or electrons through the organic layer to selectively discharge the surface charge. The charge transport layer not only serves to transport holes or electrons, but also protects the photoconductive layer from abrasion or chemical attack.

The charge transport layer is normally transparent in a wavelength region in which the electrophotographic imaging member is to be used when exposure is effected therethrough to ensure that most of the incident radiation is utilized by the underlying charge generating layer. The charge transport layer should exhibit negligible charge generation, and discharge if any, when exposed to a wavelength of light useful in xerography, e.g., 4000 to 9000 Angstroms. When used with a transparent substrate, imagewise exposure or erase may be accomplished through the substrate with all light passing through the substrate. In this case, the charge transport material need not transmit light in the wavelength region of use if the charge generating layer is sandwiched between the substrate and the charge transport layer. The charge transport layer in conjunction with the charge generating layer is an insulator to the extent that an electrostatic charge placed on the charge transport layer is not conducted in the absence of illumination. The charge transport layer should trap minimal charges, either holes or electrons, as the case may be, passing through it.

The charge transport layer comprises, as activating compounds, stereo-hindered charge transport molecules dispersed in normally, electrically inactive film forming polymeric materials for making these materials electrically active. These charge transport molecules may be added to polymeric materials which are incapable of supporting the injection of photogenerated holes and incapable of allowing the transport of these holes.

Examples of the binder materials for the transport layer include components, such as those described in U.S. Pat. No. 3,121,006, the disclosure of which is totally incorporated herein by reference. Specific examples of polymer binder materials include polycarbonates, acrylate polymers, vinyl polymers, cellulose polymers, polyesters, polysiloxanes, polyamides, polyurethanes, poly(cyclo olefins), and epoxies as well as block, random or alternating copolymers thereof. Preferred electrically inactive binders are comprised of polycarbonate resins with a molecular weight of from about 20,000 to about 100,000 or with a molecular weight $M_w$ of from about 50,000 to about 100,000 being particularly preferred. Generally, the transport layer contains from about 10 to about 75 percent by weight of the charge transport component, and more specifically, from about 20 percent to about 50 percent of this material.

Examples of binders include polycarbonates such as poly (4,4'-isopropylidene-diphenylene)carbonate (also referred to as bisphenol-A-polycarbonate, poly(4,4'-cyclohexylidine-diphenylene) carbonate (referred to as bisphenol-Z polycarbonate), poly(4,4'-isopropylidene-3,3'-dimethyl-diphenyl) carbonate (also referred to as bisphenol-C-polycarbonate) and the like. Any suitable charge transporting polymer may also be used in the charge transporting layer of this invention.

The dried charge transport layer has in embodiments a thickness of from about 5 to about 500 micrometers and more specifically has a thickness of, for example, from about 10 micrometers to about 50 micrometers. In general, the ratio of the thickness of the charge transport layer to the charge generating layer is in embodiments maintained from about 2:1 to about 200:1, and in some instances as great as about 400:1.

Optionally, an overcoat layer and/or a protective layer can also be utilized to improve resistance of the photoreceptor to abrasion. In some cases, an anticurl back coating may be applied to the surface of the substrate opposite to that bearing the photoconductive layer to provide flatness and/or abrasion resistance where a web configuration photoreceptor is fabricated. These overcoating and anticurl back coating layers are well known in the art, and can comprise thermoplastic organic polymers or inorganic polymers that are electrically insulating or slightly semiconductive. Overcoatings are continuous and typically have a thickness of less than about 10 microns, although the thickness can be outside this range. The thickness of anticurl backing layers generally is sufficient to balance substantially the total forces of the layer or layers on the opposite side of the substrate layer. An example of an anticurl backing layer is described in U.S. Pat. No. 4,654,284, the disclosure of which is totally incorporated herein by reference. A thickness of from about 70 to about 160 microns is a typical range for flexible photoreceptors, although the thickness can be outside this range. An overcoat can have a thickness of at most 3 microns for insulating matrices and at most 6 microns for semi-conductive matrices. The use of such an overcoat can still further increase the wear life of the photoreceptor, the overcoat having a wear rate of 2 to 4 microns per 100 kilocycles, or wear lives of from about 150 to about 300 kilocycles.

The photoreceptor of the disclosure is utilized in an electrophotographic image forming member for use in an electrophotographic imaging process. As explained above, such image formation involves first uniformly electrostatically charging the photoreceptor, then exposing the charged photoreceptor to a pattern of activating electromagnetic radiation such as light, which selectively dissipates the charge in the illuminated areas of the photoreceptor while leaving behind an electrostatic latent image in the non-illuminated areas. This electrostatic latent image may then be developed at one or more developing stations to form a visible image by depositing finely divided electroscopic toner particles, for example from a developer composition, on the surface of the photoreceptor. The resulting visible toner image can be transferred to a suitable receiving member such as paper. The photoreceptor is then typically cleaned at a cleaning station prior to being re-charged for formation of subsequent images.

The photoreceptor of the present disclosure may be charged using any conventional charging apparatus, which may include, for example, an AC bias charging roll (BCR), see, for example, U.S. Pat. No. 5,613,173, incorporated herein by reference in its entirety. Charging may also be effected by other well known methods in the art if desired, for example utilizing a corotron, dicorotron, scorotron, pin charging device, and the like.

The following procedures and examples are provided to illustrate the preparation of the charge transport materials and charge transport layers incorporating such materials. It must be understood that these examples are intended to be illustrative only and that the development is not intended to be limited to the materials, conditions, process parameters and the like recited herein.

EXAMPLE I

Synthesis of Stereo-Hindered Charge Transport Molecule 5.16 grams of TPD, 12.2 grams of triphenylmethyl chloride, 0.2 grams of zinc acetate, and 100 ml of acetic acid were mixed by stirring. The mixture was heated in an oil bath at 120° C. for 16 hours under argon gas flow. The mixture was then cooled and poured into 300 ml of water. A white precipitate formed, which was collected by filtration and then washed with water and methanol. The filtered product was dissolved in toluene and purified by Filtrol®. The molecular structure of the final product was confirmed by NMR to be the stereo-hindered aromatic amine is N,N'-di-4-(triphenylmethyl)phenyl-N,N'-di-(3-methyl-4-(triphenylmethyl))phenyl-1,1'biphenyl-4,4'-diamine, represented by:

Formula C

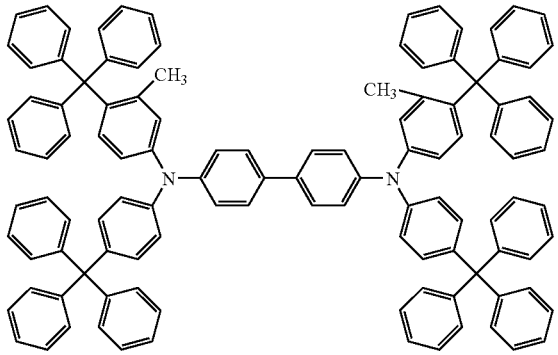

In this highly stereo-hindered TPD derivative, the nitrogen atoms are shielded by the triphenylmethyl groups at the two ends The size of this large charge transport molecule is about 28 Å.

Formulation of Charge Transport Layer Materials

The above stereo-hindered charge transport material was miscible with polymer binders for example, polycarbonate, to form charge transport layer (CTL). The content of this charge transport molecule in CTL can be about 20 to 75 weight percent. Most common organic solvents like tetrahydrofuran, methylene chloride, chloro-benzene, toluene and their combinations can be used as coating solvents. The total solid to total solvents of the coating material may for example, be around about 10:90 weight percent to about 30:70 weight percent, and in embodiments from about 15:85 weight percent to about 25:75 weight percent.

Figure 2:
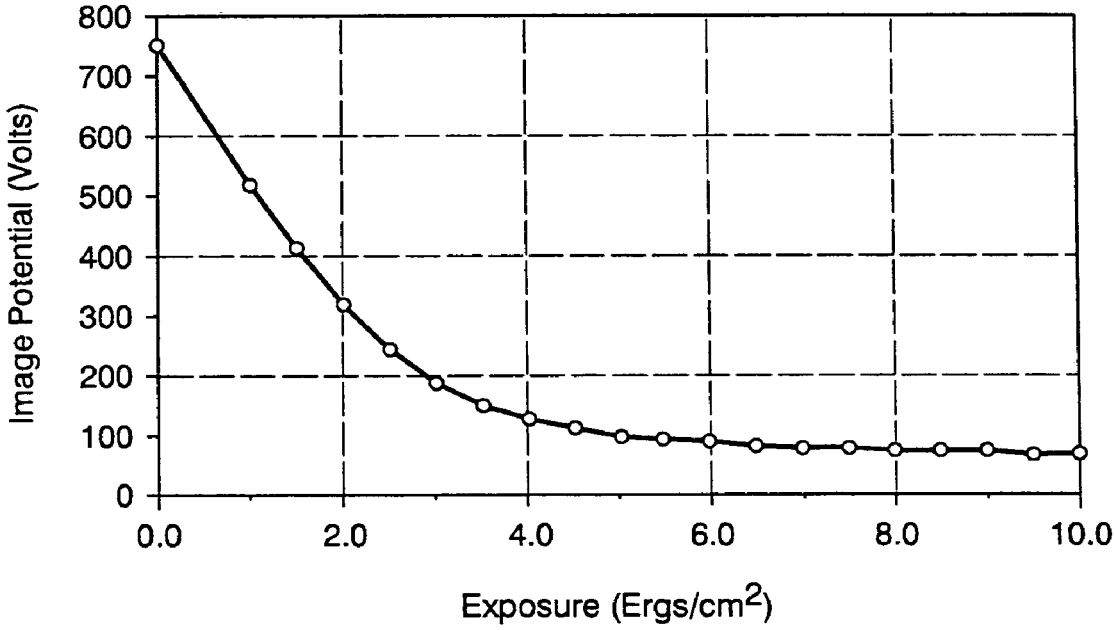
FIG. 2 is a photo-induced discharge curve (PIDC) of the photoreceptor device with a charge transport layer having the stereo-hindered TPD.

Layered photoreceptor devices were made by hand coating charge transport layer solutions, comprising the above described stereo-hindered charge transport molecule, on plant coated charge generation layers of hydroxygallium phthalocyanine (OHGaPc) in poly(4,4'-diphenyl-1,1'-cyclohexane carbonate)-200, with a weight average molecular weight of 20,000. The device was oven dried at 100 degrees Celsius for 30 minutes. When scanned in a drum scanner, the charge transport was good, and there was no residual voltage cycle up in 10 k cycles. The PIDC of this device is shown in FIG. 2. This device has excellent electrical properties.

Crystallization Test

To test for crystallization the charge transport layer solution with the newly synthesized stereo-hindered charge transparent molecule was coated over an AMAT up to charge generating layer film with a 4 ml coating bar. The film was dried under regular lab drying conditions of 120° C. for 1 minute, than heated at 140° C. for 30 minutes. Control devices containing conventional films containing unmodified m-TBD materials exhibit marked crystallization. Using stereo-hindered charge transport materials of the development, no crystallization was observed using microscopic techniques.

Although the development has been described with reference to specific embodiments, it is not intended to be limited thereto. Rather, those having ordinary skill in the art will recognize that variations and modifications, including equivalents, substantial equivalents, similar equivalents, and the like may be made therein which are within the spirit of the development and within the scope of the claims.

The invention claimed is:

1. An imaging member comprising:

a supporting substrate;

a charge generating layer; and a charge transport layer;

wherein the charge transport layer comprises a charge transport molecule represented by the formula:

Formula B

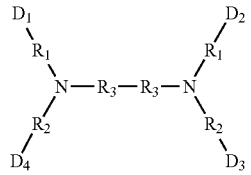

where $R_1$ and $R_2$ are independently selected from the group consisting of alkyl with from 1 to 12 carbon atoms, an alkyl with from 1 to 12 carbon atoms substituted by aryl groups, substituted or unsubstituted phenyl, substituted or unsubstituted naphthyl, substituted or unsubstituted ethyl, and substituted or unsubstituted poly phenyl;

$R_3$ is selected from the group consisting of substituted or unsubstituted aryl, alkyl having from 1 to 18 carbon atoms, and cycloaliphatic compounds having from 3 to 18 carbon atoms, and $D_1$, $D_2$, $D_3$, and $D_4$ are tertiary alkyl independently selected from the group consisting of triphenylmethyl, tert-butyl, tri(methylphenyl)methyl, tri(ethylphenyl)methyl, and tri(tert-butylphenyl)methyl.

2. The imaging member of claim 1, wherein $D_1$, $D_2$, $D_3$, and $D_4$ are each triphenyl methyl.

3. The imaging member of claim 1, wherein $R_1$ and $R_2$ are independently selected from the group consisting of substituted or unsubstituted phenyl.

4. The imaging member of claim 3, wherein $D_1$, $D_2$, $D_3$, and $D_4$ are triphenylmethyl.

5. The imaging member of claim 3, wherein $D_1$, $D_2$, $D_3$, and $D_4$ are in the position para to their respective nitrogen.

6. The imaging member of claim 5, wherein $D_1$, $D_2$, $D_3$, and $D_4$ are triphenylmethyl.

7. An imaging member comprising:

a supporting substrate;

a charge generating layer; and a charge transport layer;

wherein the charge transport layer comprises a charge transport molecule represented by the formula:

Formula C

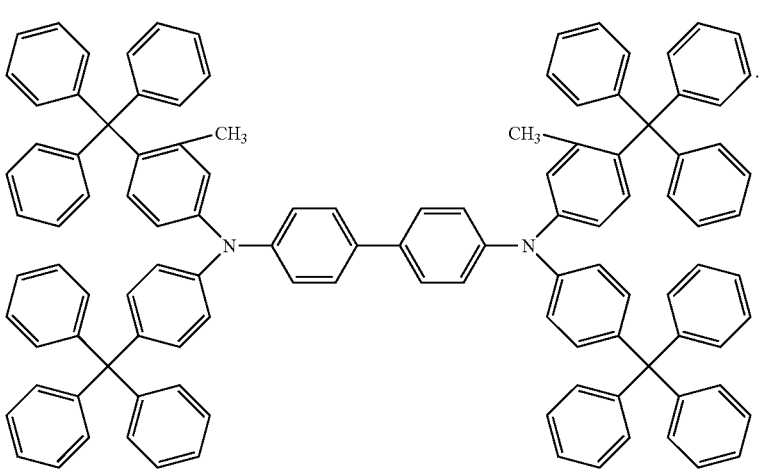

8. An imaging member comprising a charge transport layer, wherein the charge transport layer comprises a stereo-hindered charge transport molecule having the formula:

Formula A

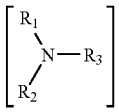

wherein $R_1$ and $R_2$ are independently selected from the group consisting of substituted or unsubstituted phenyl, naphthyl, and polyphenyl;

$R_3$ is selected from the group consisting of substituted or unsubstituted aryl, alkyl having from 1 to 18 carbon atoms, and cycloaliphatic compounds having from 3 to 18 carbon atoms; and at least one of $R_1$ and $R_2$ have a bulky organic compound attached thereto, the bulky organic compound being selected from the group consisting of triphenylmethyl, tert-butyl, tri(methylphenyl)methyl, tri(ethylphenyl)methyl, and tri(tert-butylphenyl)methyl.

9. The imaging member of claim 8, wherein the bulky organic compound is triphenylmethyl.

10. An imaging member comprising a charge transport layer, wherein the charge transport layer comprises a stereo-hindered charge transport molecule having the formula:

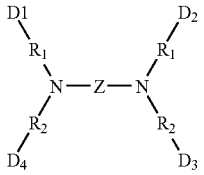

where $R_1$ and $R_2$ are independently selected from the group consisting of alkyl with from 1 to 12 carbon atoms, an alkyl with from 1 to 12 carbon atoms substituted by aryl groups, substituted or unsubstituted phenyl, substituted or unsubstituted naphthyl, substituted or unsubstituted ethyl, and substituted or unsubstituted poly phenyl;

$R_3$ is selected from the group consisting of substituted or unsubstituted aryl, alkyl having from 1 to 18 carbon atoms, and cycloaliphatic compounds having from 3 to 18 carbon atoms;

$D_1$, $D_2$, $D_3$, and $D_4$ are tertiary alkyl independently selected from the group consisting of triphenylmethyl, tert-butyl, tri(methylphenyl)methyl, tri(ethylphenyl)methyl, and tri(tert-butylphenyl)methyl; and Z is selected from the group consisting of

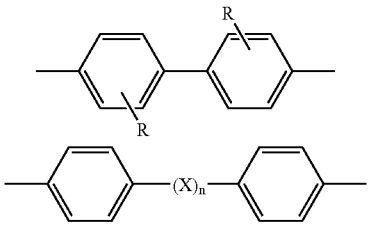

-continued
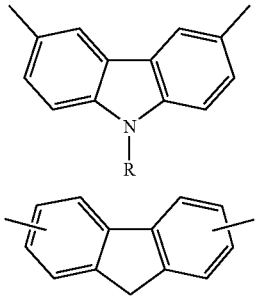
-continued
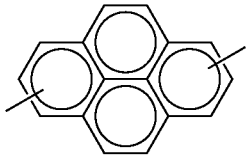
wherein the R of the Z group is selected from the group consisting of methyl, ethyl, propyl, and n-butyl; X is selected from the group consisting of —$CH_2$—, —$C(CH_3)_2$—, —O—, and —S—; and n is 0 or 1.
* * * * *